US009267382B2

(12) United States Patent
Szwedowicz et al.

(10) Patent No.: US 9,267,382 B2
(45) Date of Patent: Feb. 23, 2016

(54) ROTATING MACHINE

(75) Inventors: Jaroslaw Leszek Szwedowicz, Bad Zurzach (CH); Alexey Mozharov, Nussbaumen (CH); Stefan Irmisch, Oberrohrdorf (CH)

(73) Assignee: ALSTOM TECHNOLOGY LTD, Baden (CH)

( * ) Notice: Subject to any disclaimer, the term of this patent is extended or adjusted under 35 U.S.C. 154(b) by 1085 days.

(21) Appl. No.: 13/297,288

(22) Filed: Nov. 16, 2011

(65) Prior Publication Data

US 2012/0128473 A1 May 24, 2012

(30) Foreign Application Priority Data

Nov. 19, 2010 (CH) ..... 1947/10

(51) Int. Cl.

| | |
|---|---|
| ***F01D 5/18*** | (2006.01) |
| ***F01D 5/08*** | (2006.01) |
| ***F01D 17/14*** | (2006.01) |
| ***F01D 25/08*** | (2006.01) |

(52) U.S. Cl.

CPC *F01D 5/187* (2013.01); *F01D 5/08* (2013.01); *F01D 17/14* (2013.01); *F01D 25/08* (2013.01); *F05D 2300/505* (2013.01)

(58) Field of Classification Search

CPC ..... F01D 9/065; F01D 25/14; F01D 25/08; F01D 25/12; F01D 5/187; F01D 5/08; F01D 17/14

See application file for complete search history.

(56) References Cited

U.S. PATENT DOCUMENTS

| | | | | |
|---|---|---|---|---|
| 4,375,891 | A | 3/1983 | Pask | |
| 6,485,255 | B1 * | 11/2002 | Care et al. | 415/12 |
| 8,079,803 | B2 | 12/2011 | Takamura et al. | |
| 8,757,508 | B2 * | 6/2014 | Haasz et al. | 236/102 |
| 2002/0076318 | A1 | 6/2002 | Patel | |
| 2007/0235080 | A1 | 10/2007 | Hocking | |
| 2009/0226327 | A1 | 9/2009 | Little et al. | |
| 2010/0288376 | A1 | 11/2010 | Haasz | |
| 2011/0162387 | A1 | 7/2011 | Chir et al. | |

FOREIGN PATENT DOCUMENTS

| | | | |
|---|---|---|---|
| EP | 1843030 | A2 | 10/2007 |
| GB | 2 354 290 | A | 3/2001 |
| GB | 2 470 253 | A | 11/2010 |
| JP | 57-5505 | A | 1/1982 |
| JP | 08-296455 | A | 11/1996 |
| JP | 2012-504724 | A | 2/2012 |
| WO | 2010/001656 | A1 | 1/2010 |

OTHER PUBLICATIONS

European Patent Office, European Search Report in Swiss Patent Application No. CH 1947/2010 (Jan. 28. 2011).

(Continued)

*Primary Examiner* — Dwayne J White
*Assistant Examiner* — Adam W Brown
(74) *Attorney, Agent, or Firm* — Buchanan Ingersoll & Rooney PC

(57) ABSTRACT

A rotating machine cooled by a cooling medium directed through the rotating machine in a main flow and a secondary flow includes a rotor. A stator includes a swirl passage configured to guide the secondary flow so as to be discharged from a pre-swirl nozzle. At least one control device includes a shape-memory alloy disposed in an area of the pre-swirl nozzle and is configured to control the secondary flow based on a temperature in an automated manner.

6 Claims, 5 Drawing Sheets

(56) References Cited

OTHER PUBLICATIONS

Office Action (Notification of Reasons for Refusal) issued on Jan. 5, 2015, by the Japanese Patent Office in corresponding Japanese Patent Application No. 2011-253752, and an English Translation of the Office Action. (4 pages).

Office Action (Notification of Reasons for Refusal) issued on Sep. 28, 2015, by the Japanese Patent Office in corresponding Japanese Patent Application No. 2011-253752, and an English translation of the Office Action.

* cited by examiner

ROTATING MACHINE

CROSS REFERENCE TO PRIOR APPLICATIONS

Priority is claimed to Swiss Application No. CH 01947/10, filed on Nov. 19, 2010, the entire disclosure of which is hereby incorporated by reference herein.

FIELD

The present invention relates to the field of power-generating machines.

BACKGROUND OF THE INVENTION

In power-generating rotating machines, such as gas turbines or electric generators, the necessary cooling of thermally heavily loaded parts represents an essential physical parameter which has an effect on the overall efficiency and the service life of the system. In most cases, air is used as cooling medium, but steam, which is tapped from a steam generator, can also be used for the same purpose. The present invention, although it is explained by way of example of an air-cooled gas turbine, is not limited to a particular type of cooling and can therefore be used for all types of cooling media.

In FIG. 1, a part of a gas turbine 10 is shown in detail. In this gas turbine 10, intake air, by means of a compressor 11 which comprises a compressor casing 31 and also compressor stator blades 32 and compressor rotor blades 33, is compressed from the ambient pressure to a predetermined operating pressure. After compression, the flow of compressed air is split into compressor-air main flow 12 and a secondary flow 13. After the compressor-air main flow 12 has cooled the hot part of the combustion chamber, it is used in the combustion chamber for combusting a fuel in order to produce hot gas for operating a turbine. The secondary flow 13 of the compressed air is directed from the compressor 11, via cooling passages 14, to the high-temperature region 15 of the gas turbine 10. There, the cooling medium is used for internal cooling of the stator blades 16 and rotor blades 17 of the turbine. In addition, the cooling medium reduces the temperatures on the stator blade fastenings 18 and on the rotating parts, such as on the blade roots 19 and blade necks 20 which, on account of the rotational speed 21 of the rotor 22 around the machine axis 34, are exposed to the extremely high centrifugal forces.

Some of the air is also used for sealing purposes, especially between the rotating and stationary parts of the gas turbine 10, such as between the stator 28 and the rotor 22 (see the sealing systems 23*a*, 23*b* and 23*c* in FIG. 1). In this case, gaps are purged with air which discharges into the hot gas passage (see hot gas main flow 29 in FIG. 1) and so, at this point, prevents the entry of hot gas and consequently local overheating.

It is customary in general to use special devices in this connection, which are referred to as pre-swirl nozzles (24 in FIG. 1), or vortex generators, which are arranged in swirl passages 27, in order to direct the air which is tapped from the compressor 11 to the high-temperature region 15 of the turbine for cooling the rotor 22 and the rotating hot parts, such as the blade roots 19, the blade necks 20 and the blade platforms 25.

Under operating conditions, the thermal load on the hot components of the turbine can decrease or increase, depending upon whether the gas turbine 10 is run under partial load or full load. For example, a reduction of the output power of the gas turbine is customarily brought about as a result of a lowering of the flame temperature in the combustion chamber. Depending upon the demanded power, the gas turbine can be operated at full load and partial load, wherein full load corresponds to the nominal operating conditions. The different operating states are controlled by variable guide vanes (VGV) in the compressor stages, which alter their stagger angle in dependence upon the desired output power. As a result of this, a maximum or lower air mass flow is produced at a constant rotational speed 21.

The magnitude of the flow velocity c of the air downstream of swirl vanes 26 which are arranged in the swirl passages 27 (see FIGS. 1 and 2) is a linear function of the mass flow in the swirl passages 27. For normal operation of the gas turbine, which corresponds to full load, the resulting velocity w is provided by the relationship $$w=2\pi\cdot R\cdot\Omega\cdot c,$$

wherein Ω is the rotational speed 21 of the turbine and R is the mean radius at the outlet of the swirl passages 27 (see FIG. 2). The resulting air velocity w influences the total temperature $T_t$ according to the relationship $$T_t T+w^2/(2C_p),$$

wherein T refers to the static temperature and $C_p$ refers to the specific heat.

For a constant rotational speed Ω, the partial load is achieved by means of the variable guide vanes VGV which reduce the mass flow in the compressor 11. Subsequently, the air velocity c downstream of the swirl device (swirl vanes 26) reduces. Ultimately, the resulting velocity w is also influenced by this, which directly affects the metal temperatures of the rotating hot parts, such as the blade roots 19, the blade necks 20 and the platforms 25. If the metal temperature at constant rotational speed is kept constant, the corresponding mechanical components are not exposed to low cycle fatigue (LCF). This could technically be achieved by means of controlled valves. In actual fact, however, the swirl device is not usually provided with control elements, which can influence the mass flow in the cooling passages 14 since this region of the rotor 22 and the stator 28 is accessible only to a limited degree.

Controlling the cooling air distribution in the rotor 22, in the stator 28 and in the turbine blades 27 is a complicated undertaking, which is additionally made more difficult as a result of the requirement for avoiding backflows. Resulting from this is the fact that a simple throttling does not represent a satisfactory solution and that it is advantageous to use a control device with an aerodynamically optimized design. Such a device is the pre-swirl nozzle 24 which is customarily formed by means of a stationary row of blade airfoils in the style of turbine guide vanes (swirl vanes 26 in FIG. 3*a*). These swirl vanes 26 are fastened on the stator 28 between the compressor 11 and the high-temperature region 15. A constriction 35 (FIG. 3*b*), with a corresponding area F (FIG. 3*c*), is formed between the swirl vanes 26.

If a simple, functionally reliable, automatic control of the mass flow could be realized in a simple manner in the region of the pre-swirl nozzle 24, a particularly effective cooling of the corresponding regions at different load states of the turbine could be realized without great cost.

GB 2 354 290 describes controlling the cooling air flow through the inside of a turbine blade in a gas turbine by means of a circular valve consisting of a shape-memory alloy.

A similar solution, in which sleeves consisting of a shape-memory alloy are inserted in the individual disks of the turbine and alter the cross section of cooling medium passages in dependence upon temperature, is described in printed publication US 2009/0226327 A1.

In both cases, it concerns the main flow of cooling medium.

Furthermore, the printed publication GB 2 470 253 describes a device for controlling the cooling medium flow in a gas turbine. An annular flow limiter, which is provided with apertures arranged distributed over the circumference is used. The flow cross section of the apertures can be changed in each case by a valve element, the position of which in relation to the aperture is changed by means of an SMM element.

The printed publication US 2002/076318 describes the tangential injection of cooling air from outside into the rotor of a gas turbine for cooling the rotor blades. The injection takes place by mixing two separate flows, one of which is emitted from inside injector blades provided for the injection. Control by changing the cross section, in particular using a shape-memory alloy, is not disclosed.

SUMMARY OF THE INVENTION

The present invention provides a rotating machine. The rotating machine is cooled by a cooling medium directed through the rotating machine in a main flow and a secondary flow. The rotating machine includes a rotor and a stator. The stator includes a swirl passage configured to guide the secondary flow so as to be discharged from a pre-swirl nozzle. At least one control device includes a shape-memory alloy disposed in an area of the pre-swirl nozzle and is configured to control the secondary flow based on a temperature in an automated manner.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
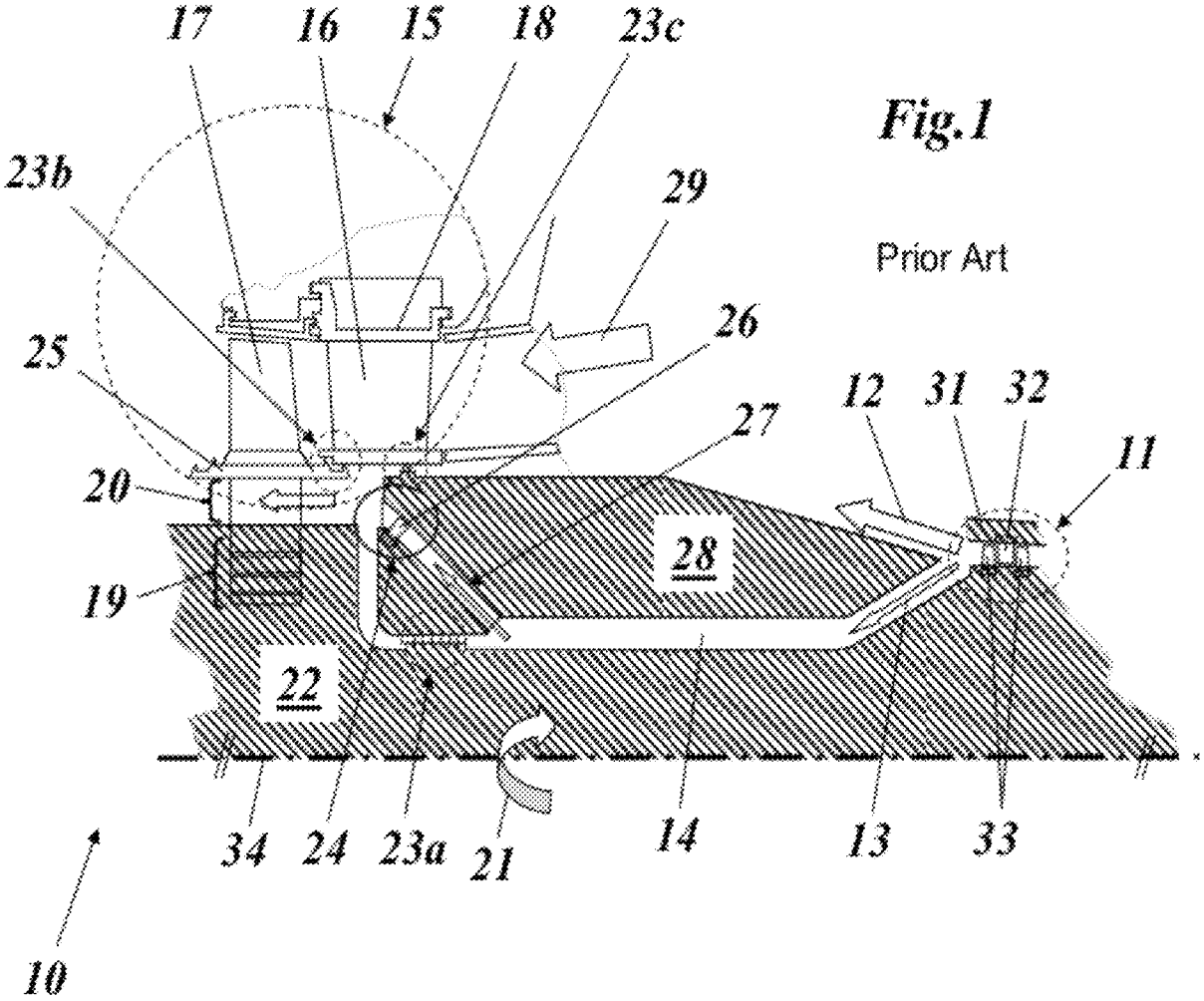
Fig.1 Prior Art
FIG. 1 shows in detail a part of a gas turbine with different ways for the distribution of cooling air.
Figure 2:
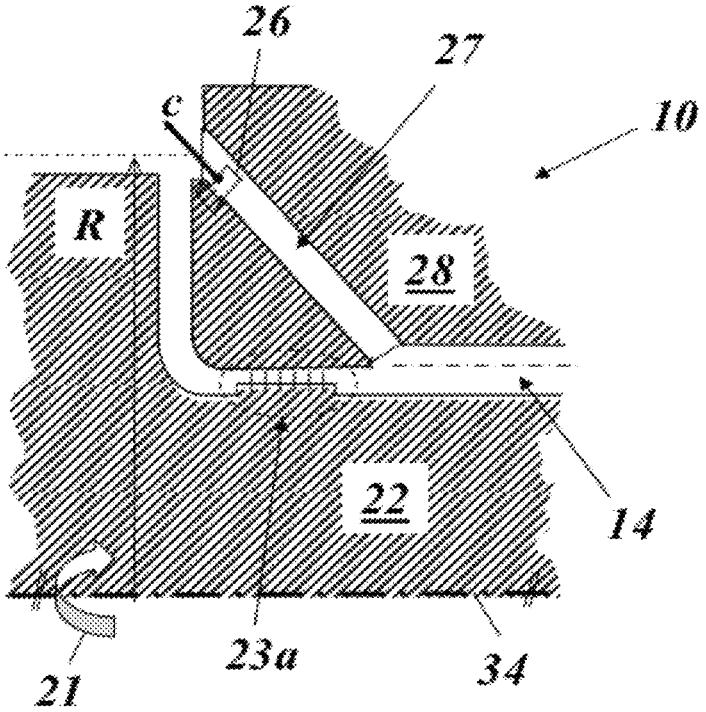
Prior Art Fig.2
FIG. 2 shows in an enlarged detail from FIG. 1 the design of the swirl passage.

In an embodiment, the invention provides a rotating machine, especially a gas turbine, in which by controlling the cooling-medium mass flow in a secondary cooling region (SAF—Secondary Air Flow), the efficiency of the cooling and the efficiency of the machine are improved.

In an embodiment, the invention is based on a rotating machine, especially a gas turbine, which is cooled by means of a cooling medium, especially cooling air, which cooling medium is directed through the machine in a main flow and in a secondary flow. The rotating machine comprises a rotor and a stator, in that the secondary flow of cooling medium is directed through swirl passages in the stator to a pre-swirl nozzle and discharges from the stator there, in that control means for the temperature-dependent, automatic control of the secondary flow are arranged in the region of the pre-swirl nozzle and in that the control means consist entirely or partially of a shape-memory alloy.

In an embodiment, the swirl vanes are arranged in the region of the pre-swirl nozzle, and in that the control means are formed in such a way that the flow cross section of the swirl passages can be altered in the region of the swirl vanes in dependence upon temperature.

According to another embodiment, the control means comprise in each case a curved membrane, consisting of a shape-memory alloy, which projects into the swirl passage and which by altering the curvature alters the cross section of the swirl passage.

A further embodiment of the invention is characterized in that the control means comprise in each case a wall element which is arranged in the swirl passage parallel to the wall, can be displaced transversely to the wall by means of adjusting elements—which consist of a shape-memory alloy and alter the length of the wall element in dependence upon the temperature—and alters the cross section of the swirl passage.

In an embodiment, the adjusting elements are especially designed as bolts or springs.

In an embodiment, the wall element, on the upstream-disposed side, is provided with a baffle plate which directs the medium flowing in the swirl passage into the cross section which is constricted by means of the wall element.

In a further embodiment, the swirl vanes are arranged in each case in a manner in which they can be displaced in the swirl passage transversely to the flow direction and in a way in which they alter the cross section, and in that provision is made for adjusting elements, consisting of a shape-memory alloy, in order to displace the swirl vanes in dependence upon temperature.

According to another embodiment, the displaceable swirl vanes, on the upstream-disposed side, are provided in each case with a baffle plate which directs the medium flowing in the swirl passage into the cross section which is constricted by means of the swirl vanes.

A further embodiment of the invention is characterized in that the control means comprise in each case a torsion element, consisting of a shape-memory alloy, which is oriented in the direction of the longitudinal axis of the swirl vanes and which, depending upon temperature, alters the set angle of the swirl vanes and, as a result, alters the flow cross section.

In an embodiment, the means are arranged in each case at the outlet of the swirl passages for temperature-dependent covering of the outlet opening.

In an embodiment, the covering means can especially comprise a temperature-controlled diaphragm.

According to one embodiment, the diaphragm, or its diaphragm elements, consists, or consist, of a shape-memory alloy and as a result of a temperature-dependent change of its dimensions alter the covering of the outlet opening.

According to another embodiment, the diaphragms consist of a plurality of diaphragm elements in each case, which are connected in each case to torsion elements, consisting of a shape-memory alloy, which rotate the diaphragm elements in a temperature-controlled manner and so alter the covering of the outlet opening.

One exemplary embodiment (FIG. 5) concerns the setting of the main flow through the stator blades, and another exemplary embodiment (FIG. 4) relates to the control of a secondary cooling medium flow in the sealing region of the rotor shaft.

According to a preferred exemplary embodiment of the invention, the pre-swirl nozzle 24 in a gas turbine 10 according to FIG. 1 is constructed entirely or partially from a shape-memory alloy (SMA). Below a predetermined limiting temperature, which can be lower than the nominal operating temperature, the part of the pre-swirl nozzle 24 which consists of a shape-memory alloy is activated and reduces the cross-sectional area in the region of the constriction of the pre-swirl nozzle 24, as a result of which the cooling-air mass flow into the high-temperature region 15 of the gas turbine 10 is effectively reduced.

Figure 3:
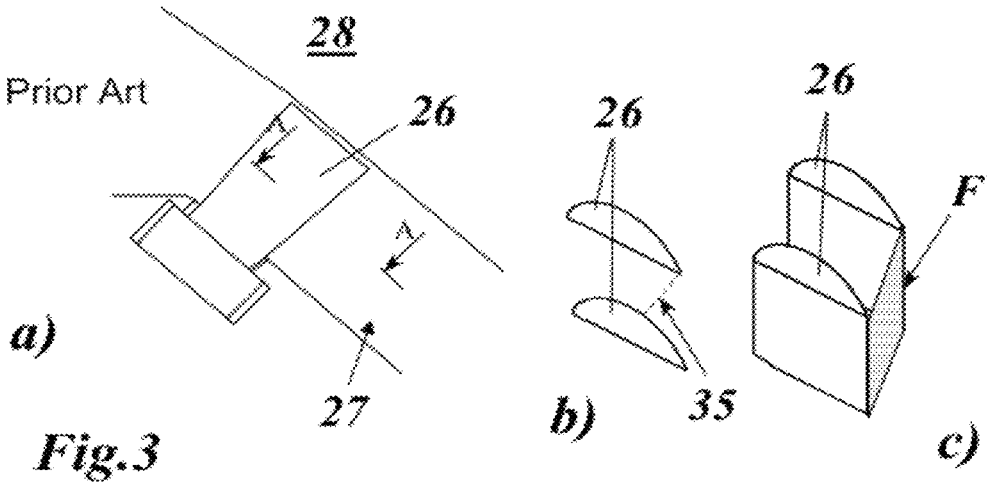
Prior Art Fig.3
FIG. 3 shows in different views 3*a-c* the swirl vanes which are arranged in the pre-swirl nozzle from FIG. 1.
Figure 4:
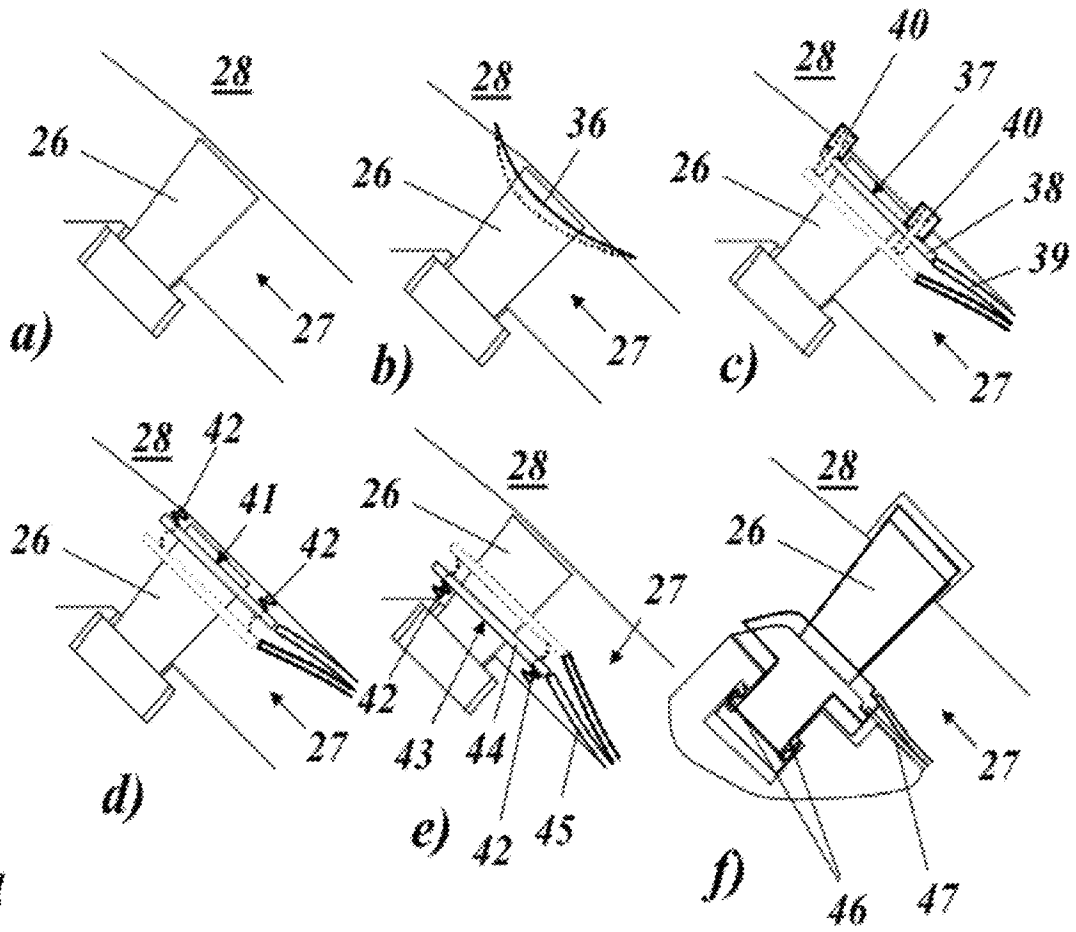
FIG. 4 shows in different sub-FIGS. 4*b-f* different exemplary embodiments for an automatic control of the cooling-air mass flow in the swirl passage according to the invention compared with the uncontrolled arrangement (FIG. 4*a*)

In this case, shrinking, stretching, torsion and bending of the parts consisting of the shape-memory alloy can be used as the mechanism for reducing the throughflow cross section of the otherwise simple system consisting of steel. FIG. 4, in comparison to the arrangement without control (FIG. 4*a*), shows different examples of how an automatically controlled pre-swirl nozzle 24 can be realized by using different arrangements consisting of a shape-memory alloy based on different types of mechanical deformation (FIGS. 4*b-f*). All the examples are based on a reduction of the area F in FIG. 3*c* by reducing the height of the swirl passage 27 as a result of a translational movement of an upper and a lower wall element 38 or 44 (FIGS. 4*c-e*), of a membrane 36 (FIG. 4*b*) or of the swirl vanes 26 themselves (FIG. 40.

In the example of FIG. 4*b*, a membrane, which is bent into the swirl passage 27, is provided in the region of the vane tip of the swirl vane 26, the curvature of which membrane is altered, and, as a result, is the flow cross section in the swirl passage 27.

In the example of FIG. 4*c*, an adjusting device 37, with a wall element 38 which is parallel to the wall, is provided in the region of the vane tip of the swirl vane 26 and can be displaced perpendicularly to the wall by means of adjusting elements 40, consisting of a shape-memory alloy, which are built into corresponding housings. The adjusting elements 40 can have the form of bolts or springs in this case. A baffle plate 39 which is arranged in front of the wall element 38 (upstream) in the flow direction and is adjustable with the wall element 38, guides the flow into the cross section which is reduced by means of the wall element 38.

In the example of FIG. 4*d*, the adjusting device 41, with the otherwise same construction as in FIG. 4*c*, has open adjusting elements 42 in the form of bolts or springs.

In the example of FIG. 4*e*, the adjusting device 43 has a wall element 44, with associated baffle plate 45, which is parallel to the wall and arranged on the side of the vane root of the swirl vane 26, and again can be displaced perpendicularly to the wall by means of adjusting elements 42 consisting of a shape-memory alloy.

In the example of FIG. 4*f*, the swirl vane 26 itself is displaced perpendicularly to the wall by means of corresponding adjusting elements 46, consisting of a shape-memory alloy, in order to alter the cross section of the swirl passage 27 (by displacing a platform). In this case also, a baffle plate 47 is provided in order to guide the flow into the constricted cross section. Naturally, the different adjusting mechanisms of FIGS. 4*b-f* can also be combined with each other.

Figure 5:
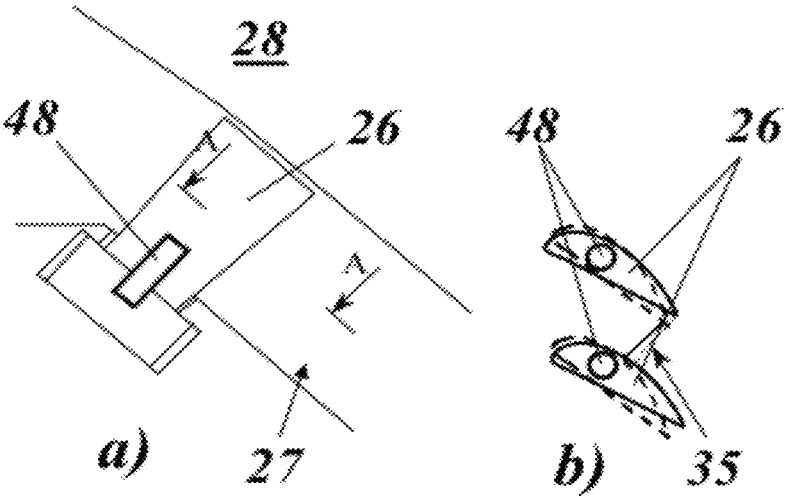
FIG. 5 shows in two different views 5*a-b* a further exemplary embodiment for an automatic control by means of pivoting of the swirl vanes.

A further example of a suitable adjusting mechanism is reproduced in FIG. 5, wherein the sub-figure a) shows a side view and the sub-figure b) shows a view from the top of the swirl vanes 26. The swirl vanes 26 in this example are rotatable around a pivot which is oriented in the longitudinal axis of the vane and formed by means of a torsion element 48 consisting of a shape-memory alloy.

As a result of corresponding rotation of the swirl vanes 26 (see continuous lines and dashed lines in FIG. 5*b*), the free flow cross section of the arrangement is altered.

Figure 6:
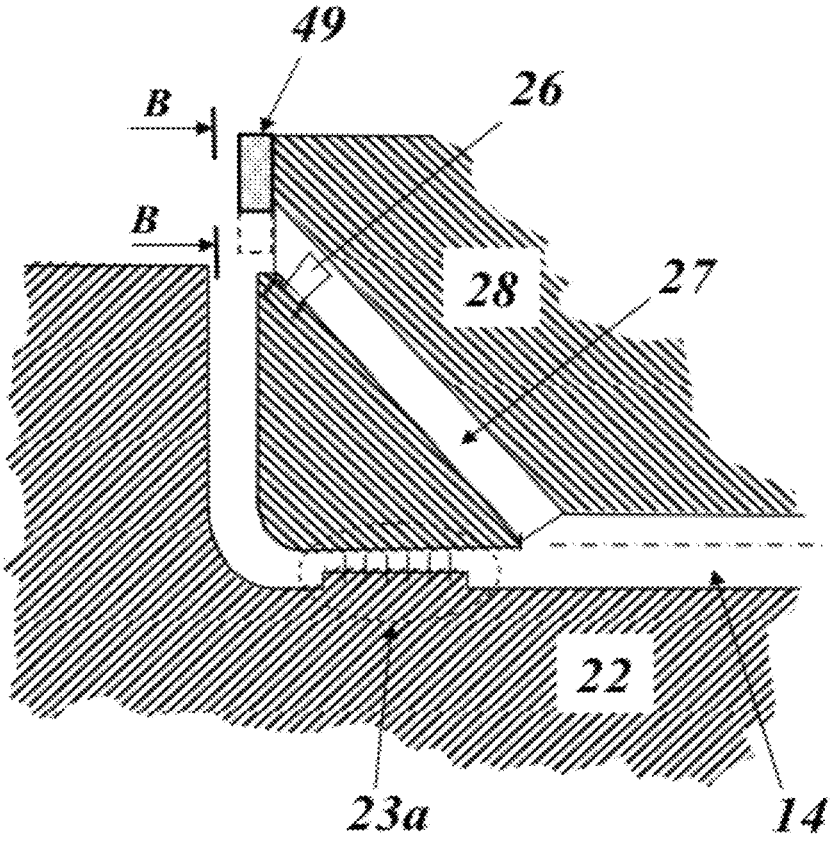
FIG. 6 shows in section a further possibility of the automatic control of the cooling-air mass flow in the swirl passage by means of automatic altering of the outlet cross section.

A further possibility is to arrange a diaphragm 49 at the outlet opening of the swirl passage 27 according to FIG. 6, which diaphragm consists entirely or partially of a shape-memory alloy and alters the outlet opening in dependence upon temperature (see dashed line to 49 in FIG. 6). If the power output of the machine is reduced and, as a result, the hot gas, the compressed air or the metal temperature of any of the parts is altered, the diaphragm 49 progressively closes and reduces the mass flow of cooling medium.

Figure 7:
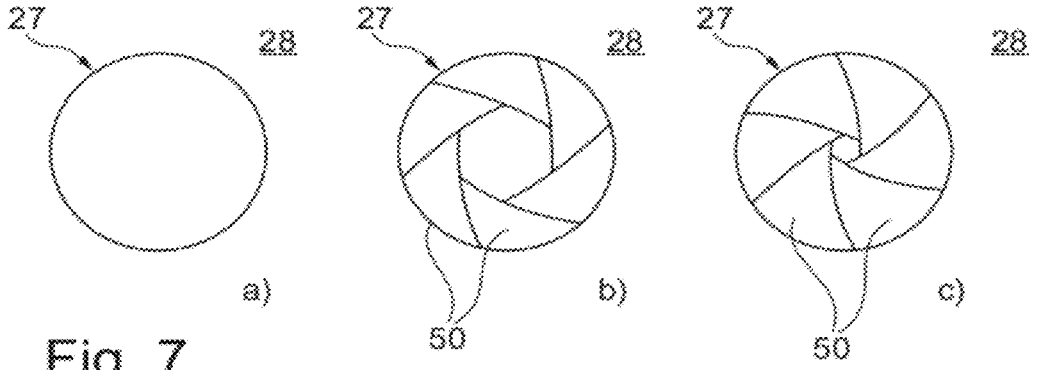
FIG. 7 shows in a plurality of sub-FIGS. 7*a-c* different states in an exemplary embodiment for an automatic control of the outlet cross section.

If the diaphragm, as shown in FIG. 7, consists of a multiplicity of diaphragm elements 50, the outlet of the swirl passage 27 is closed by degrees, as in the case of the diaphragm of a camera (FIG. 7*a* corresponds to full load, whereas FIGS. 7*b-c* correspond to partial load of the turbine).

Figure 8:
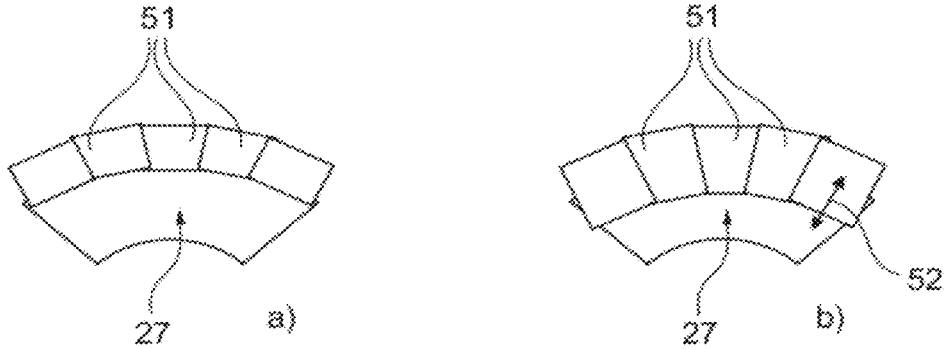
FIG. 8 shows in a plurality of sub-FIGS. 8*a-b* different states in another exemplary embodiment for an automatic control of the outlet cross section.

Depending upon the shape of the swirl passage 27, the diaphragm can also be designed like a sluice-gate which is assembled from a multiplicity of diaphragm elements 51, according to FIG. 8. Depending upon the temperature, this sluice-gate, which consists entirely or partially of a shape-memory alloy, reduces the cooling medium flow in the swirl passage 27, or cuts it off completely. In this case, the individual diaphragm elements 51, in dependence upon the temperature, are subjected to an expansion 52 which influences the cooling medium flow.

Figure 9:
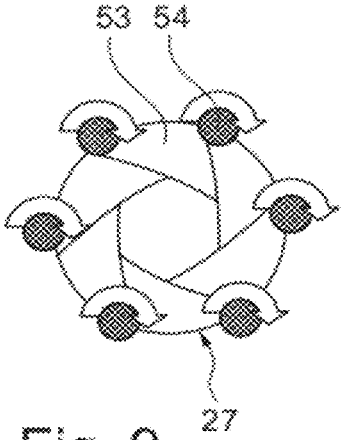
FIG. 9 shows a development comparable to FIG. 7 in which the individual elements are automatically rotated in each case around an axis.
Figure 10:
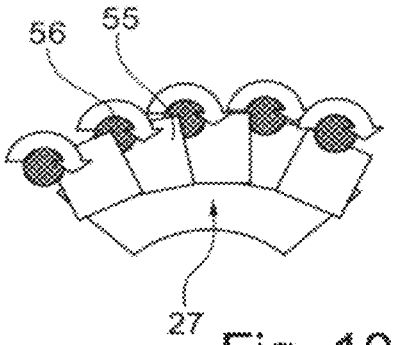
FIG. 10 shows a development comparable to FIG. 8 in which the individual elements are automatically rotated in each case around an axis.

It is also conceivable, however, to produce the arrangement according to FIG. 7 or FIG. 8 from a conventional material, wherein according to FIG. 9 or FIG. 10 the necessary rotational movement for altering the flow cross section is then impressed upon the individual diaphragm elements 53 or 55 by means of a corresponding torsion element 54 or 56 consisting of a shape-memory alloy.

Overall, the present invention describes the use of shape-memory alloys in the secondary cooling medium system of a rotating machine for efficiency-increasing control of cooling medium consumption in dependence upon the load state of the machine. The swirling which is described in the exemplary embodiment can assume different forms which necessitate the corresponding modifications to the adjusting mechanism. The described automatic control mechanism on the basis of shape-memory alloys can also be used in heat shields in order to control cooling medium consumption in dependence upon the power output (of the gas turbine).

The proposed arrangement can profit from a further lowering of the cooling medium temperature relative to the total temperature within the rotating reference framework. This leads to the possibility of further reducing the necessary cooling air mass flows and therefore of increasing the power output and efficiency of the gas turbine.

The shape-memory alloy can consist of different metallurgical compounds of various elements and can also be produced by different technologies. A change of the temperature and/or a mechanical modification to the machine starts the process of the geometry change of the component consisting of the shape-memory alloy. In the case of a reducing tolerance during assembly, the shrinking behavior of the component is taken into consideration instead of an expansion.

Although the proposed mechanism has been explained by way of example of a gas turbine, the cooling medium control on the basis of elements consisting of a shape-memory alloy can also be used in other machines, where an active, automatic control of the cooling-medium mass flow is required.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

LIST OF DESIGNATIONS

10 Gas turbine
11 Compressor
12 Compressor air main flow
13 Secondary flow
14 Cooling passage
15 High-temperature region
16 Stator blade
17 Rotor blade
18 Stator blade fastening
19 Blade root
20 Blade neck
21 Rotational speed
22 Rotor
23*a-c* Sealing system
24 Pre-swirl nozzle
25 Platform
26 Swirl vane
27 Swirl passage
28 Stator
29 Hot gas main flow
31 Compressor casing
32 Compressor stator blade
33 Compressor rotor blade
34 Machine axis
35 Constriction
36 Membrane
37, 41, 43 Adjusting device
38, 44 Wall element
39, 45, 47 Baffle plate
40, 42, 46 Adjusting element
48 Torsion element
49 Diaphragm
50, 51, 53, 55 Diaphragm element
52 Expansion
54, 56 Torsion element
F Area

The invention claimed is:

1. A rotating machine cooled by a cooling medium directed through the rotating machine in a main flow and a secondary flow, the rotating machine comprising:

a rotor;

a stator including a swirl passage configured to guide the secondary flow so as to be discharged from a pre-swirl nozzle; and at least one control device including a shape-memory alloy disposed in an area of the pre-swirl nozzle and configured to control the secondary flow based on a temperature in an automated manner, wherein a covering device is disposed at an outlet of the swirl passage and is configured to cover an opening of the outlet based on the temperature, wherein the covering device includes a temperature-controlled diaphragm, and wherein the diaphragm includes a plurality of diaphragm elements each connected to a torsion element including the shape-memory alloy, the plurality of torsion elements configured to rotate the plurality of diaphragm elements in a temperature-controlled manner so as to alter the covering of the outlet opening.

2. The rotating machine as recited in claim 1, wherein the rotating machine is a gas turbine, and wherein the cooling medium is cooling air.

3. The rotating machine as recited in claim 1, wherein the swirl passage includes a swirl vane disposed in the area of the pre-swirl nozzle, and wherein the at least one control device is configured to alter a flow cross section of the swirl passage in an area of the swirl vane based on the temperature.

4. The rotating machine as recited in claim 1, wherein the diaphragm includes the shape-memory alloy such that a temperature-dependent change of a dimension of the diaphragm alters the covering of the opening of the outlet.

5. The rotating machine as recited in claim 1, wherein at least one of the diaphragm elements includes the shape-memory alloy such that a temperature-dependent change of a dimension of the at least one diaphragm element alters the covering of the opening of the outlet.

6. The rotating machine as recited in claim 1, wherein the pre-swirl nozzle is in the secondary flow, and the at least one control device including the shape-memory alloy is disposed in the area of the pre-swirl nozzle in the secondary flow.

* * * * *